US006103179A

United States Patent [19]

Larsson

[11] Patent Number: 6,103,179

[45] Date of Patent: Aug. 15, 2000

[54] METHOD AND ARRANGEMENT FOR PRODUCING A FIBRE PRODUCT

[75] Inventor: Johan Peter Larsson, Norrkoping, Sweden

[73] Assignee: Celtec Development AB, Norrkoping, Sweden

[21] Appl. No.: 09/091,344

[22] PCT Filed: Dec. 12, 1996

[86] PCT No.: PCT/SE96/01644

§ 371 Date: Jun. 12, 1998

§ 102(e) Date: Jun. 12, 1998

[87] PCT Pub. No.: WO97/22755

PCT Pub. Date: Jun. 26, 1997

[30] Foreign Application Priority Data

Dec. 15, 1995 [SE] Sweden ..... 9504497

[51] Int. Cl.[7] ..... B28B 1/26

[52] U.S. Cl. ..... 264/489; 264/492; 264/87; 425/85; 425/174.4; 425/356

[58] Field of Search ..... 264/86, 87, 489, 264/492; 425/84, 85, 356, 174.4

[56] References Cited

U.S. PATENT DOCUMENTS

| | | | |
|---|---|---|---|
| 3,250,839 | 5/1966 | De Luca . | |
| 3,510,394 | 5/1970 | Cadotte . | |
| 3,624,806 | 11/1971 | Lytzen . | |
| 3,645,320 | 2/1972 | Varrati . | |
| 3,850,793 | 11/1974 | Hornbostel et al. . | |
| 3,870,777 | 3/1975 | Jakel . | |
| 4,203,936 | 5/1980 | Kiwak et al. . | |
| 4,683,028 | 7/1987 | Waller et al. . | |
| 5,338,169 | 8/1994 | Buckley | 264/489 |
| 5,364,258 | 11/1994 | Buckley et al. | 264/489 |
| 5,641,449 | 6/1997 | Owens | 265/489 |

FOREIGN PATENT DOCUMENTS

| | | | |
|---|---|---|---|
| 38 37 467 | 5/1990 | Germany . | |
| 1162676 | 2/1994 | Germany | 264/492 |
| 123831 | 5/1990 | Japan | 264/492 |

*Primary Examiner*—Karen Aftergut
*Attorney, Agent, or Firm*—Merchant & Gould P.C.

[57] ABSTRACT

The invention relates to a method and an arrangement for manufacturing a fiber product. The method and the process are characterized in that a first male mold (6) is immersed in stock in a molding tank **(2*a*). By means of a vacuum, fibers are induced to form a fiber layer of predetermined thickness on the male mold (6). The male mold (6) is thereafter removed from the molding tank (2*a*) and a female mold (8) is brought under force against the male mold (6) in order to express the stock water, following which the fiber product (P) is transferred to the female mold (8). A second male mold (10) is brought under force against the female mold (8)** so that the fiber is subjected to pressing in order to increase the dry solids content of the fiber product and give this a predetermined external structure, following which the fiber product (P) is released and subjected to final drying under the effect of microwave or IR radiation.

6 Claims, 3 Drawing Sheets

METHOD AND ARRANGEMENT FOR PRODUCING A FIBRE PRODUCT

Figure 1:
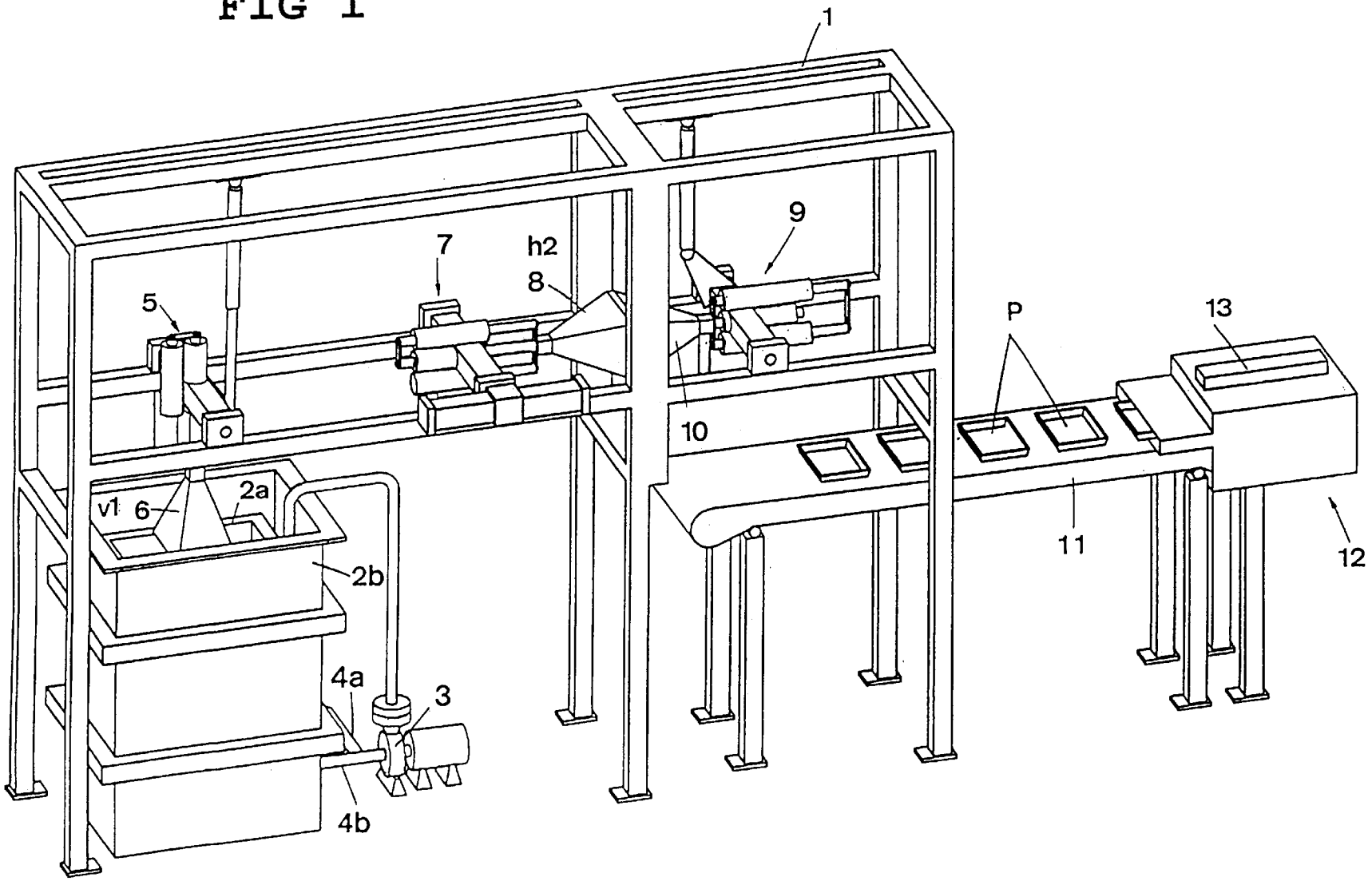

The present invention relates to a method of manufacturing a fibre product, the stock being prepared so that it has a predetermined fibre water concentration and contains predetermined additives and chemicals.

The invention also relates to an arrangement for manufacturing such a fibre product from a fibre stock which is briefly stored in a machine vat.

A machine for the moulding of fibre products in which a perforated male mould is immersed in a fibre suspension is already known from U.S. Pat. No. 3,850,793. The suspension water is sucked through the perforations by means of a vacuum, the fibres in the suspension catching on the surface of the mould. Once a layer of a certain thickness has been obtained on the mould this is moved to a station directly under a press, by means of which the excess water is pressed out, following which the product now obtained is blown away from the mould and subjected to final drying.

An arrangement for such final drying is already know, for example, from U.S. Pat. No. 3,624,806. Use is made here of heated air which is blown by fans through a drying oven, through which the products have to pass.

A male mould is already known from DE-C2-38 37 467. In this mould the perforations are formed by openings between spheres which are fixed to one another at their point of contact.

A problem with known arrangements for manufacturing a fibre product is that, in order for it to be profitable the product has to be manufactured in vary large quantities. This means that it has hitherto not been economically justifiable, for example, to use fibre packagings as an alternative to polystyrene (PS) or expanded polystyrene (EPS) packagings, which are relatively inferior from an environmental standpoint.

A customer for a fibre product usually wants to have his logotype placed at a suitable point on the product. In known arrangements of the above-mentioned type the finished product is provided with such a logotype in a special hot pressing operation.

This obviously means an increase in the cost of manufacture and the time taken to manufacture the product.

The object of the present invention is to arrive at a method of manufacturing a fibre product which means that the shape of the product can be easily modified, thereby permitting manufacture in short series, and that manufacture can be accomplished more quickly with a lower energy consumption and better surface finish than previously. According to the invention this is achieved through the following combination of measures:

stock is pumped to a moulding tank, a first male mould performs an operating cycle in which it is first immersed in the stock in the moulding tank and fibres in the stock are induced by means of a vacuum to successively form the future product with a fibre layer of predetermined thickness, the male mould is then removed from the moulding tank and assumes a predetermined position, a female mould performs a cyclical series of movements in which it is brought under force against the male mould in the said predetermined position so that a first pressing occurs, following which the fibre product is transferred to the female mould which is moved to a predetermined position, a second male mould performs an operating cycle in which it is first brought under force against the female mould in the said predetermined position, so that the fibre product is subjected to a second pressing, following which the female mould assumes a predetermined position in which the fibre product is released therefrom, the fibre product is subjected to final drying under the effect of microwave or IR radiation.

According to a special characteristic of the invention the product is provided with a logotype in the second pressing stage.

An arrangement for manufacturing a fibre product according to this method is characterised in that the arrangement comprises a combination of:

a machine stand, a moulding tank arranged on or connected to the stand and enclosed by a collecting tank, a pump arranged in a line between the machine vat and the moulding tank and adapted to pump an abundance of fibre stock from the machine vat to the moulding tank in such a way that excess stock is able to flow over the brim of the moulding tank and down into the collecting tank, a moulding unit arranged on the stand and adapted in one operating cycle to first immerse a first male mould in the moulding tank, a fibre product with a certain layer thickness being produced on the tool in a manner known in the art by extracting the stock water, and thereafter to move the male mould to a first horizontal position, a pick-up unit arranged on the stand and adapted to cyclically move a female mould, first to the first horizontal position in order there to subject the fibre product to a first pressing and to pick this from the first male mould and thereafter move the female tool to a second horizontal position, a pressing section arranged on the stand comprising a movably supported second male mould, adapted first in the second horizontal position to be forcibly pressed against the female mould in order to increase the dry solids content of the fibre product and to give this a predetermined external structure, and thereafter to release this from the female mould, a drying section arranged on or against the stand and comprising a conveyor arrangement for receiving the product released from the female mould and radiation sources for final drying of the product.

According to a special characteristic of the arrangement according to the invention the pressing stage male mould has a relief section adapted to give the product a logotype.

According to a second special characteristic of the arrangement according to the invention the radiation sources are microwave or IR radiation sources, by means of which rapid, energy-efficient drying is achieved.

Figure 2:
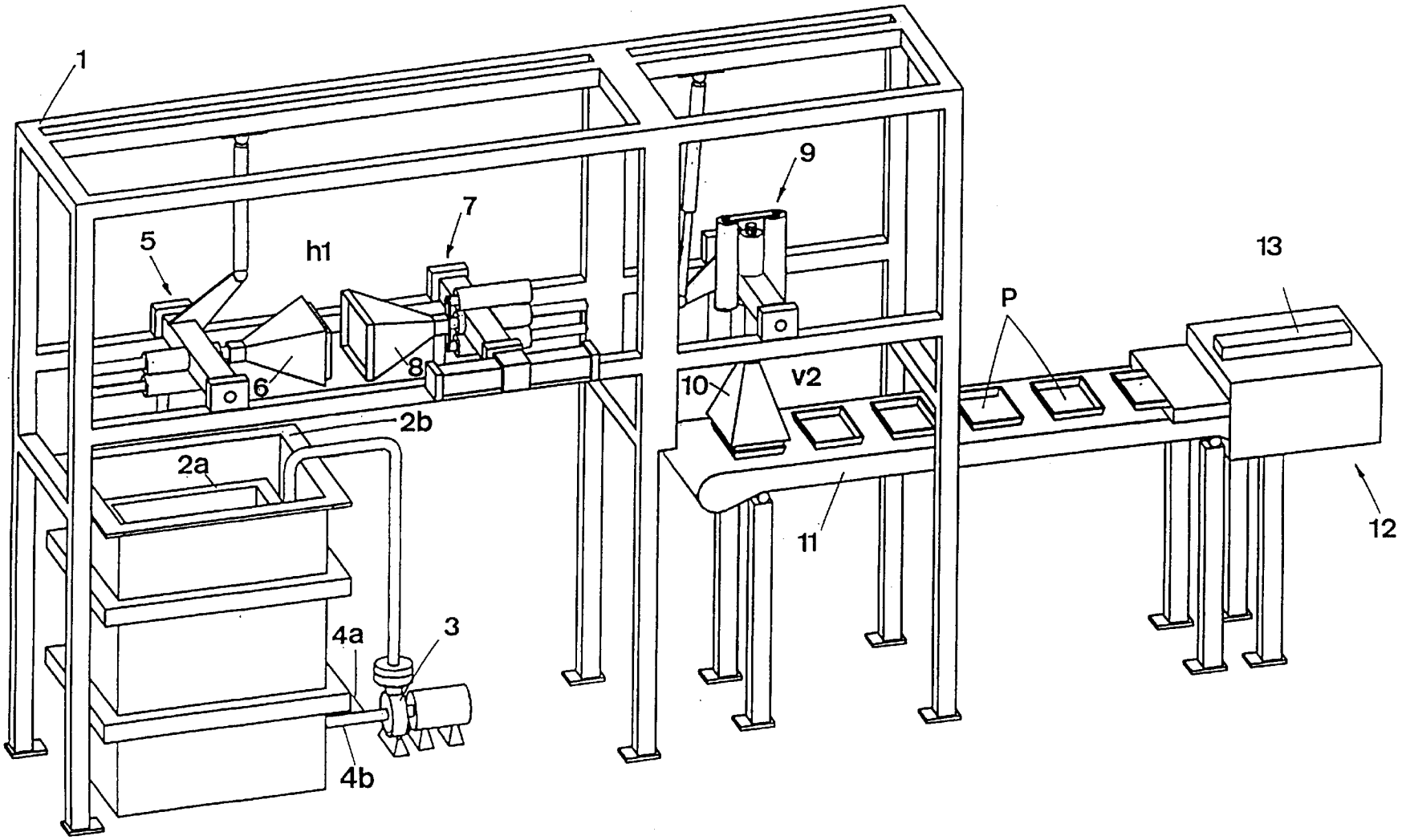

The invention will be explained below with reference to the attached drawing in which FIGS. 1 and 2 show an example of an arrangement for performing the method according to the invention and more specifically two different stages in the said method. The figure, as an example, shows a plan view of a male mould with a relief, which produces a logotype on a fibre product.

It will be described, with reference to FIGS. 1 and 2, how an arrangement according to the invention can be constructed and also, in connection with this, how the arrangement functions according to the method according to the invention.

In FIGS. 1 and 2, 1 denotes a machine stand and 2*a* a moulding tank, arranged on or against the stand and surrounded by a collecting tank 2*b*. A preferably electrically driven pump 3 is arranged in a pipeline 4*a* between the moulding tank 2*a* and a machine vat, not shown on the drawing, for briefly storing fibre stock. The pump 3 is adapted to pump an abundance of stock so that excess stock flows over the brim of the moulding tank 2*a* and down into the collecting tank 2*b*, which connects by way of a line 4*b* with the pump 3, so that excess stock is also returned to the moulding tank 2*a*. The person skilled in the art will perceive that for this to succeed there is a need to control the pump 3 and valves, not shown in more detail, in the lines 4*a* and 4*b*.

A movably supported moulding unit 5 with a male mould 6 is situated on the stand.

The moulding unit 5 is adapted to allow the male mould 6 to perform an operating cycle in which the latter is first immersed in the stock in the moulding tank 2*a* and assumes a first vertical position v1, to be moved after a certain time to a horizontal position h1, see FIGS. 1,2. During the time the male tool 6 is immersed in the stock, the stock water is drawn off through ducts in the tool, fibres in the stock being collected on the outside of the tool 6 so that after the said period of time a fibre product is produced with the desired layer thickness. The tool is preferably of a known type, manufactured by sintering spheres together, a body with a predetermined porosity being formed.

Figure 3:
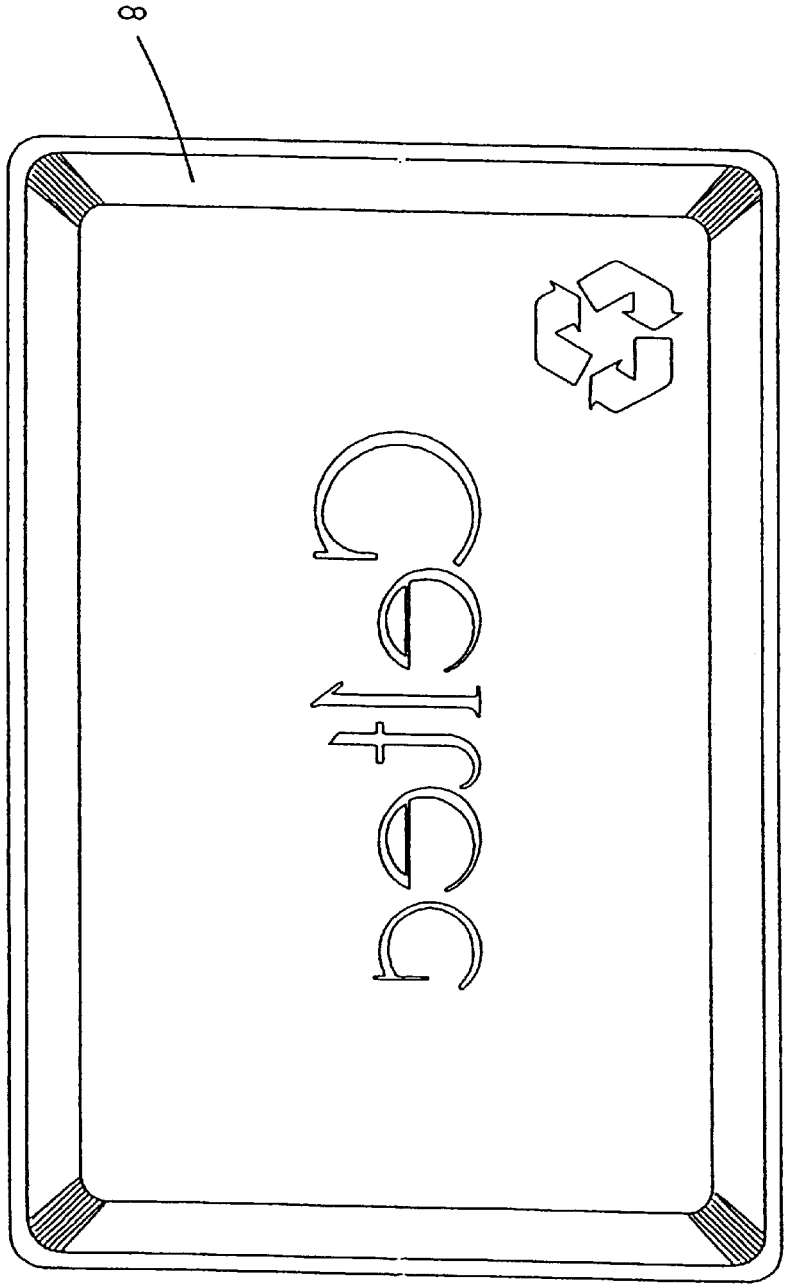

Also situated on the stand is a pick-up unit 7, adapted to cyclically move a female mould 8 between the first horizontal position hi and a second horizontal position h2, see FIG. 2. The female mould 8, in the first horizontal position h1, is adapted to be first moved against the male mould 6 in order thereby to subject the fibre product to a first pressing and thereafter to be moved from the male mould 6 and thereby pick the product from the latter. The female mould 8 and the fibre product are then moved to the second horizontal position h2, see FIG. 1. The female mould 8, as shown, for example, in FIG. 3, is formed with a relief section which on the fibre product produces impressions in the form of a logotype, an is this case also an environmental symbol.

A pressing section 9 is situated on the stand 1 downstream of the pick-up unit. This section comprises a movably supported second male mould 10, adapted to be cyclically moved between the second horizontal position h2 and a second vertical position v2. In the second horizontal position h2 the male mould 10 is first moved forcibly against the female mould 8 in order to increase the dry solids content of the fibre product. The male mould 10 is thereafter moved from the female mould 8 and moved to the vertical position v2 in which it releases the fibre product, so that the latter, as denoted in the drawing by the letter P, can drop down on to a conveyor belt 11, see FIG. 2. This constitutes a part of a drying section 12, arranged on or against the stand 1, which drying section also comprises radiation sources 13 arranged above the conveyor belt for final drying of the fibre product. The radiation sources are preferably microwave or IR radiation sources.

As will be seen from the drawing, the tool movements are performed as efficiently as possible without unnecessary pauses, that is to say during the work of the pressing section 9 the male mould 6 of the moulding unit 5 assumes the position v1 again, see FIG. 1. Similarly the work in the pick-up stage 7, as will be seen from FIG. 2, takes place at the same time that the pressing section 9 is performing the work which concludes with the product P being dropped on to the belt 11.

The arrangement explained above and shown in the drawing is obviously to be regarded only as an example of how the idea of the invention can be realised and it is the task of the person skilled in the art to effect, within its framework, the modifications and adjustments which may be required having regard to local conditions.

What is claimed is:

1. Method of manufacturing a fibre product from stock with a predetermined fibre/water concentration and containing predetermined additives and chemicals the method comprising the steps of:

a. pumping the stock to a moulding tank, b. immersing a first male mould in the stock in the moulding tank wherein fibres in the stock are induced by means of a vacuum to successively form a fibre layer of predetermined thickness for the fiber product, c. removing the first male mould from the moulding tank to assume a first predetermined position, d. performing a cyclical sequence of movements with a female mould in which, in a first pressing stage, the female mould is brought under force against the male mould in the first predetermined position, so that a first expressing of stock water occurs, following which the fibre product is transferred to the female mould which is moved to a second predetermined position, e. performing an operating cycle in which, in a second pressing stage, a second male mould is brought under force against the female mould in the second predetermined position, so that the fibre product is subjected to a second expressing, following which the female mould assumes a third predetermined position in which the fibre product is released therefrom, and f. subjecting the fibre product to final drying using microwave or IR radiation.

2. Method according to claim 1, wherein the fibre product in the second pressing stage is provided with a logotype.

3. Arrangement for manufacturing a fibre product from a fibre stock which is briefly stored in a machine vat, the arrangement comprising:

a. a machine stand, b. a moulding tank arranged on or connected to the machine stand and surrounded by a collecting tank, c. a pump arranged in a line between the machine vat and the moulding tank and adapted to pump an abundance of fibre stock from the machine vat to the moulding tank in such a way that excess fibre stock is able to flow out of the moulding tank and into the collecting tank, d. a moulding unit arranged on the machine stand and adapted in one operating cycle to first immerse a first male mould in the moulding tank to produce a fibre product with a predetermined layer thickness on the first male mould by deposition of the fibre stock onto the first male mould, and thereafter to move the first male mould to a first horizontal position, e. a pick-up unit arranged on the machine stand and adapted to cyclically move a female mould, first to the first horizontal position in order there to subject the fibre product to a first pressing and to pick the fibre product from the first male mould and then move the female mould to a second horizontal position, f. a pressing section arranged on the machine stand and comprising a movably supported second male mould, adapted first in the second horizontal position to be forcibly pressed against the female mould in order to dry the fibre product and to give the fibre product a predetermined external structure and thereafter to release the fibre product from the female mould in a vertical position, and g. a drying section arranged on or against the machine stand and comprising a conveyor arrangement for receiving the fibre product released from the second male mould and radiation sources for final drying of the fibre product.

4. Arrangement according to claim 3, wherein the female mould of the pick-up unit has a relief section adapted to give the fibre product a logotype in the pressing section.

5. Arrangement according to claim 3, wherein the radiation sources are microwave sources.

6. Arrangement according to claim 3, wherein the radiation sources are IR radiation sources.

* * * * *